United States Patent [19]

Franke

[11] 4,335,310

[45] Jun. 15, 1982

[54] X-RAY DIAGNOSTIC GENERATOR COMPRISING ADJUSTMENT MEANS FOR THE X-RAY TUBE VOLTAGE

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 226,847

[22] Filed: Jan. 21, 1981

[30] Foreign Application Priority Data

Feb. 12, 1980 [DE] Fed. Rep. of Germany ..... 3005182

[51] Int. Cl.[3] ..... H05G 1/32

[52] U.S. Cl. ..... 250/408; 250/421

[58] Field of Search ..... 250/408, 409, 402, 421

[56] References Cited

U.S. PATENT DOCUMENTS 4,206,357 6/1980 Franke ..... 250/408

FOREIGN PATENT DOCUMENTS 2037767 2/1972 Fed. Rep. of Germany .

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an exemplary embodiment a variable ohmic resistance in the high voltage circuit of the x-ray tube is formed of a series of individual resistors which can be individually bridged by means of electronic switches. There can be connected, in parallel with at least one individual resistance, a series of fine adjustment resistances which can be individually bridged by means of further electronic switches.

3 Claims, 2 Drawing Figures

X-RAY DIAGNOSTIC GENERATOR COMPRISING ADJUSTMENT MEANS FOR THE X-RAY TUBE VOLTAGE

BACKGROUND OF THE INVENTION

The invention relates to an x-ray diagnostic generator comprising adjustment means for the x-ray tube voltage which are formed by a variable ohmic resistance in the high voltage circuit of the x-ray tube.

An x-ray diagnostic generator of this type is described, for example, in the German OS No. 20 37 767. In this known x-ray diagnostic generator, the ohmic resistance is formed by a triode whose grid bias voltage is so adjusted that the voltage drop at the triode is so great that the desired x-ray tube voltage is connected to the x-ray tube. The triode must be dimensioned for a relatively high voltage also in the case in which it does not serve the purpose of switching on and off the x-ray tube, but only of adjustment of the x-ray tube voltage. Due to the necessary, relatively high dielectric strength of the triode, the latter represents an expensive component.

SUMMARY OF THE INVENTION

The object underlying the invention resides in creating an x-ray diagnostic generator of the type initially cited which, with a relatively inexpensive construction, permits a comparatively precise adjustment of the x-ray tube voltage.

This object is achieved in accordance with the invention in that the resistance is comprised of a series of individual resistances which are capable of being individually bridged by means of electronic switches. In the case of the inventive x-ray diagnostic generator, simple resistances e.g. carbon-film resistances, and inexpensive electronic switches e.g. thyristors, are sufficient for the adjustment of the x-ray tube voltage. For an increase in the precision, it is expedient to connect, parallel to at least one individual resistance, a series of fine adjustment resistances which can be individually bridged by means of the electronic switches. In this case, via the individual resistances, first a course adjustment takes place, and the fine adjustment then takes place via the fine adjustment resistances connected in parallel with one of the individual resistances. The fine adjustment resistances can also be replaced by a triode whose ohmic resistance is continuously adjustable for the purpose of fine adjustment via the control grid. In this instance, the demands made of the dielectric strength of the triode are relatively minor.

The invention shall be explained in greater detail in the following on the basis of two exemplary embodiments illustrated on the accompanying drawing sheets; and other objects, features and advantages will be apparent from this detailed disclosure and from the appended claims.

DETAILED DESCRIPTION

Figure 1:
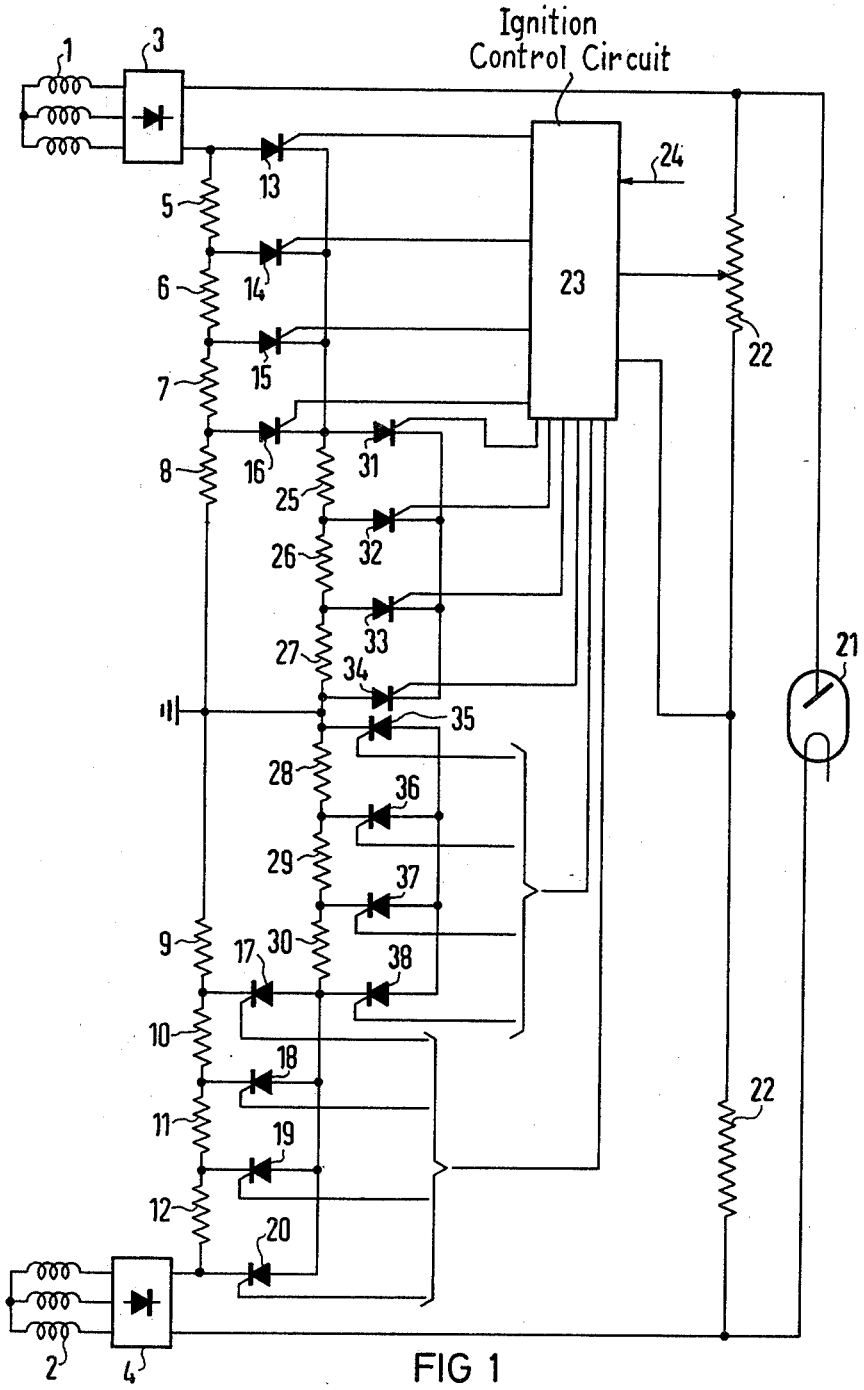
FIGS. 1 and 2 are electric circuit diagrams for illustrating the respective embodiments.

In the exemplary embodiments, the secondary side of the three-phase current-high voltage transformer with two secondary winding groups 1 and 2 is illustrated which are connected to two high voltage rectifiers 3 and 4. Via a series of ohmic individual resistances 5 through 12, the high voltage rectifiers 3 and 4 are connected in series with one another. The resistors 5 through 12 are capable of being individually bridged by thyristors 13 through 20. The high voltage rectifiers 3, 4, feed an x-ray tube 21. The center of the series-connection of the individual resistances 5 through 12 is connected to ground. In addition, there is connected, parallel to the x-ray tube 21, a voltage divider 22 at which a signal corresponding to the actual value of the x-ray tube voltage, is tapped. Thus signal from voltage divider 22 is applied to an ignition control device 23, FIG. 1, or 23*a*, FIG. 2, respectively. The ignition control device 23, or 23*a*, receives, at one input 24, a signal corresponding to the nominal value of the desired x-ray tube voltage.

In the exemplary embodiment according to FIG. 1, the ignition control device 23 controls the thyristors 13 through 20 such that a predetermined number of the individual resistances 5 through 12 is short-circuited, so that, at the part of the individual resistances 5 through 12, still connected in series with the high voltage rectifiers 3, 4, a voltage drop is present which has as a consequence a desired voltage of the x-ray tube 21. The fine adjustment of the x-ray tube voltage proceeds in the example according to FIG. 1 through fine adjustment resistances 25 through 30, which can be selectively short-circuited by means of thyristors 31 through 38, and can be connected in parallel with the individual resistances 8, or 9, respectively. The ignition control device 23 activates the thyristors 31 through 38 such that, via the fine adjustment resistances 25 through 30, a fine adjustment of the x-ray tube voltage takes place to provide as precise as possible a correspondency of the actual value with the nominal value.

Figure 2:
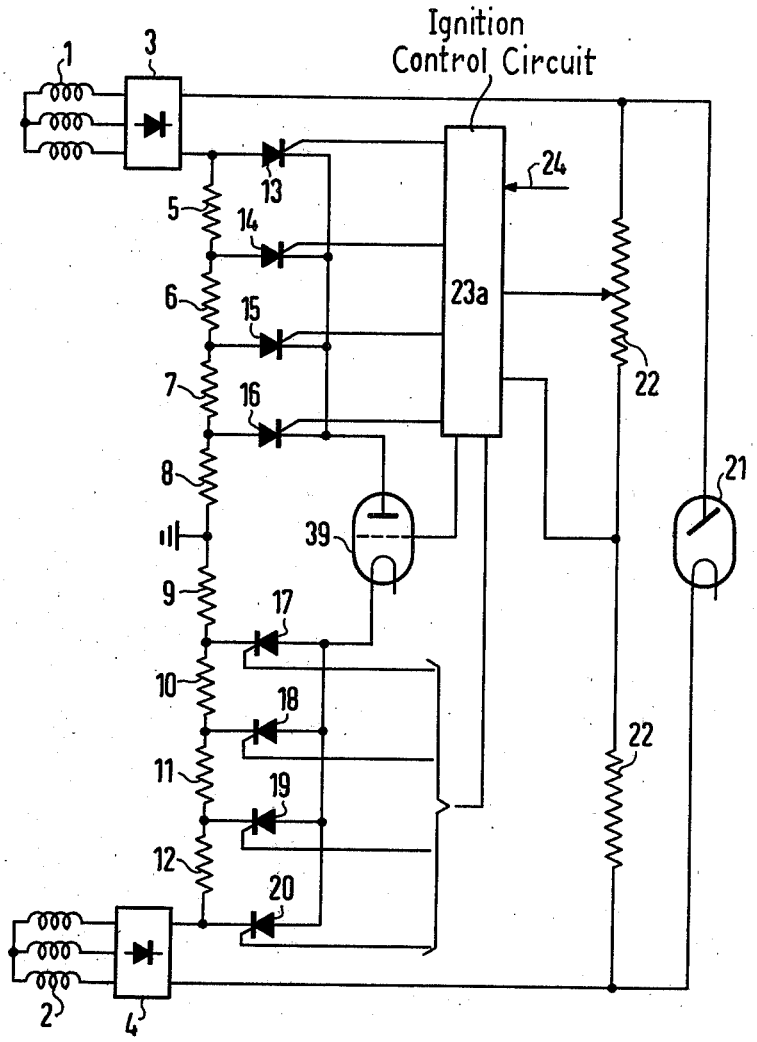

In the example according to FIG. 2, the fine adjustment resistances 25 through 30 are replaced by a triode 39 which is activated by the ignition control device 23*a* for the purpose of fine adjustment such that the voltage drop at the triode 39 results in as precise as possible a correspondency between the actual value and the nominal value of the x-ray tube voltage.

A particularly expedient construction of the x-ray diagnostic generator results if it is fed with a frequency which is raised in relation to the mains frequency and if the x-ray tube is provided with a control grid via which the x-ray tube current is controlled and via which the x-ray tube can be switched on and off. Like the filament supply transformer of the x-ray tube, and possibly also the high voltage transformer, the components connected to the control grid can here be jointly installed in the x-ray tube housing together with the high voltage rectifier and resistances.

It will be apparent that many modifications and variations may be effected without departing from the scope of the novel concepts and teachings of the present invention.

I claim as my invention:

1. An x-ray diagnostic generator comprising an x-ray tube having a high voltage circuit, adjustment means for adjusting the x-ray tube voltage comprising a variable ohmic resistance in the high voltage circuit of the x-ray tube, said resistance comprising a series of individual resistances (5 through 12), and electronic switches (13 through 20) individually actuatable to bypass selected ones of said individual resistances (5 through 12).

2. An x-ray diagnostic generator according to claim 1, with a series of fine adjustment resistances (25 through 30) connected in parallel with at least one of said individual resistances (8, 9), and further individually actuatable electronic switches (31 through 39) for selectively bypassing selected ones of said fine adjustment resistances (25 through 30).

3. An x-ray diagnostic generator according to claim 1, with a triode (39) connected in parallel with at least one of said individual resistances (8, 9), said triode (39) presenting an ohmic resistance and having a control grid for providing a fine adjustment of the ohmic resistance presented thereby.

* * * * *